United States Patent [19]

Yabunaka

[11] Patent Number: 4,558,668

[45] Date of Patent: Dec. 17, 1985

[54] AUXILIARY POWER OUTPUT DEVICE FOR AN INTERNAL COMBUSTION ENGINE

[75] Inventor: Kiyoshi Yabunaka, Himeji, Japan

[73] Assignee: Mitsubishi Denki Kabushiki Kaisha, Tokyo, Japan

[21] Appl. No.: 662,151

[22] Filed: Oct. 18, 1984

[30] Foreign Application Priority Data

Oct. 19, 1983 [JP] Japan ..... 58-162290[U]

[51] Int. Cl.[4] ..... F02F 7/00

[52] U.S. Cl. ..... 123/195 A; 123/179 D

[58] Field of Search ..... 123/195 R, 195 A, 179 D; 74/6

[56] References Cited

U.S. PATENT DOCUMENTS

| | | | |
|---|---|---|---|
| 1,930,533 | 10/1933 | Niven | 123/195 A |
| 2,041,861 | 5/1936 | Reese | 123/179 B |
| 2,784,710 | 3/1957 | Kremser | 123/195 A |
| 2,887,100 | 5/1959 | Papst | 123/179 D |
| 3,263,663 | 8/1966 | Connell | 123/195 R |
| 4,074,589 | 2/1978 | Nakamura et al. | 123/195 A |
| 4,170,211 | 10/1979 | Worthington | 123/179 B |
| 4,257,281 | 3/1981 | Bunger | 123/179 D |

FOREIGN PATENT DOCUMENTS

| | | | |
|---|---|---|---|
| 0094149 | 4/1923 | Austria | 74/6 |

*Primary Examiner*—Craig R. Feinberg

*Attorney, Agent, or Firm*—Oblon, Fisher, Spivak, McClelland & Maier

[57] ABSTRACT

An auxiliary power output device for an internal combustion engine comprises a ring gear fixed to a crank shaft of an internal combustion engine and interlocked with a pinion of a starter motor, a pulley attached to an auxiliary output shaft and a belt wound between the pulley and the ring gear.

2 Claims, 4 Drawing Figures

AUXILIARY POWER OUTPUT DEVICE FOR AN INTERNAL COMBUSTION ENGINE

BACKGROUND OF THE INVENTION

The present invention relates to an auxiliary power output device. More particularly, it relates to an auxiliary power output device for an internal combustion engine for producing a rotational force by connecting a belt with a ring gear fixed to a crank shaft of the internal combustion engine.

An internal combustion engine which produces a rotational force by explosive power of fuel is used as a source of revolution for various kind of apparatuses.

FIG. 1 is a front view of an important part of an output producing means of an internal combustion engine used for automobiles. In the figure, a reference numeral 1 designates an internal combustion engine having a crank shaft 2 to which a flywheel 3 and a ring gear 4 are fixed. A numeral 5 designates a clutch arranged between the crank shaft 2 and an output shaft 6 to perform connection and disconnection of a rotational force; a numeral 7 designates a speed changer; a numeral 8 designates a bell housing; a numeral 9 designates a starter motor attached to the side part of the internal combustion engine 1. A numeral 10 designates a pinion mounted on the output shaft of the starter motor 9, the pinion being projected to be interlocked with the ring gear 4.

In the output producing means of the internal combustion engine constructed as above-mentioned, when a starting switch (not shown) is closed, an output of a battery is supplied to the starter motor 9. As soon as a power source is connected to the starter motor 9, it causes the pinion to project so as to interlock with the ring gear 4. Upon completion of the interlocking, the starter motor 9 rotates its output shaft thereby rotating the ring gear 4. The rotation of the ring gear 4 causes rotation of the crank shaft 2 on which the ring gear 4 is fixed, whereby the internal combustion engine 1 is started. Immediately after the starting of the internal combustion engine 1, the starting switch is opened to retract the pinion and to release engagement of the pinion with the ring gear 4, hence the ring gear stops its revolution and returns to normal condition.

The conventional device having the construction as above-mentioned has, however, a disadvantage of extremely low efficiency in use, a ring gear 4 being large-sized and relatively expensive, because it is utilized only at the time of starting the internal combustion engine.

SUMMARY OF THE INVENTION

It is an object of the present invention to provide an auxiliary power output device for an internal combustion engine increasing efficiency of use of a ring gear by utilizing it during operation of the engine thereby obtaining an auxiliary power output.

It is another object of the present invention to provide an auxiliary power output device capable of producing an auxiliary rotational output of a relatively high speed from an auxiliary output shaft, by extending a belt between a pulley mounted on the auxiliary output shaft and a ring gear.

The foregoing and the other objects of the present invention have been attained by providing an auxiliary power output device for an internal combustion engine which comprises a ring gear fixed to a crank shaft of an internal combustion engine and interlocked with a pinion of a starter motor, a pulley attached to an auxiliary output shaft and a belt wound between the pulley and the ring gear.

BRIEF DESCRIPTION OF THE DRAWINGS

The foregoing objects, other objects as well as specific construction and operation of the auxiliary power output device according to the present invention will be more apparent and understandable from the following description of it, when read in conjunction with the accompanying drawing.

In the drawing.

DETAILED DESCRIPTION OF THE PREFERRED EMBODIMENTS

An embodiment of the present invention will be described with reference to drawing.

Figure 1:
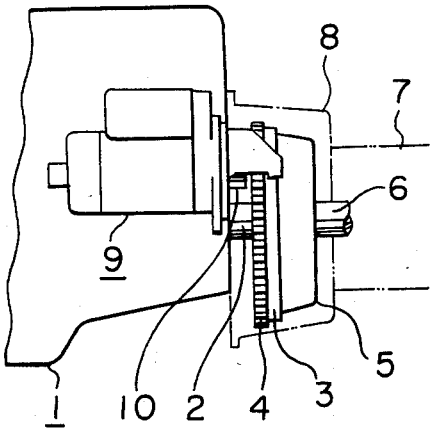
FIGURE 1 PRIOR ART
FIG. 1 is a front view partly removed of an important part of a conventional output producing means in an internal combustion engine.
Figure 2:
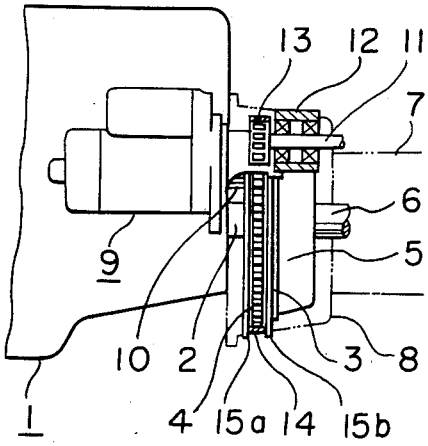
FIG. 2 is a front view partly removed of an important part of an embodiment of the auxiliary power output device for an internal combustion engine according to the present invention.

FIG. 2 is a front view partly removed of an important part of an embodiment of the auxiliary power output device for an internal combustion engine according to the present invention in which the same reference numerals as in FIG. 1 designate the same parts.

Figure 3:
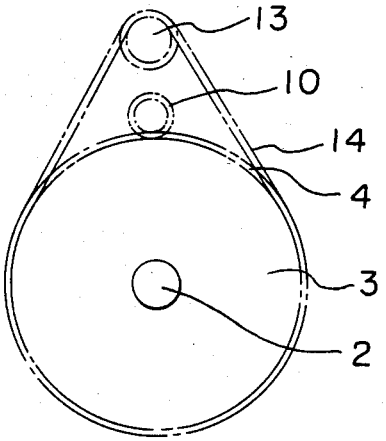
FIG. 3 is a diagram showing a transmission system for an auxiliary output in the device shown in FIG. 2.

A reference numeral 11 designates an auxiliary output shaft supported by a bearing device 12 in a freely rotatable manner, the output shaft 11 being provided with a timing pulley 13 at a position opposing the ring gear 4. A numeral 14 designates a timing belt extended between the ring gear 4 and the timing pulley 13. FIG. 3 shows relationship of the crank shaft 2, the ring gear 4, the pinion 10, the timing belt 14 and the timing pulley 13. In more detail, the pinion 10 of the starter motor is positioned in an area surrounded by the timing belt 14 which is extended between the timing pulley 13 and the ring gear 4 and in which the belt 14 does not wind around the ring gear 4. Guide plates 15*a* and 15*b* are fixed at both side surfaces of the ring gear 4.

Figure 4:
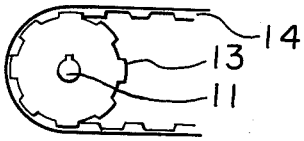
FIG. 4 is a front view of an example of a combination of a belt and a pulley used for the auxiliary power output device of the present invention.

FIG. 4 shows an embodiment of a combination of the timing pulley 13 and the timing belt 14. The timing pulley 13 is provided with a series of alternate projections and recesses with a constant pitch in the outer circumferential surface. The timing belt 14 is provided at its reverse surface with a series of shallow grooves which are fitted to the projections and recesses of the pulley 13 to be driven. Use of the timing belt 14 minimizes production of metallic sound in comparison with use of the combination of a chain and a gear and provides accurate transmission without causing slippage. The body of the timing belt 14 is formed of rubber material such as chloroprene and preferably, steel wire or cotton yarn is included in the body to prevent elongation of the belt 14.

In the device constructed as above-mentioned, actuation of the internal combustion engine 1 causes the timing pulley 13 to continuously rotate because the timing belt 14 is usually wound between the ring gear 14 and the timing pulley 14. The timing pulley 13 is fixed to the auxiliary output shaft 11 whereby a rotational force is always produced by the auxiliary output shaft 11 during the operation of the enging 1. In this case, the diameter of the ring gear 4 is made relatively large so as to easily start the internal combustion engine 1 by the starter motor 9 and to produce an output of a relatively high revolution speed from the auxiliary output shaft 11. Accordingly, the device of the present invention is suited to drive an auxiliary rotating device requiring a large output and high revolution, such as a supercharger, alternator etc.

In the above-mentioned embodiment, although detailed description has not been made as to construction of the starter motor, it is possible to use any starter motor such as an electromagnetic insertion type, an inertia-sliding type, an air turbine type etc. Further, another type of the belt can be used to connect the ring gear 4 with the timing pulley 13 instead of the timing belt.

As described above, in accordance with an auxiliary power output device for an internal combustion engine of the present invention, there are obtainable excellent advantages of a simple structure, of easy production of an auxiliary output of revolution having a high revolution and a large torque during the operation of an internal combustion engine and of capable of efficient utilization of a ring gear, by providing such construction that a belt is wound around the ring gear to produce a rotational output.

I claim:

1. In an internal combustion engine having a crankshaft, a ring gear fixed to a flywheel of said crankshaft and a starter motor including a pinion having a diameter substantially less than said ring gear and means for selectively engaging said starter motor pinion with said ring gear, an auxiliary power output device comprising:

an auxiliary power output shaft driving an auxiliary device;

a pulley fixed to said output shaft; and a belt drivingly wound between said ring gear and said pulley, wherein said ring gear, said starter motor and said pulley are relatively positioned such that said starter motor pinion is spaced from and surrounded by said belt and is directly engageable with said ring gear at a circumferential position where said belt does not wind around said ring gear.

2. The internal combustion engine according to claim 1, wherein said pulley is constituted by a timing pulley and said belt is constituted by a timing belt.

* * * * *